US010699825B2

(12) United States Patent
Tanaka et al.

(10) Patent No.: US 10,699,825 B2
(45) **Date of Patent: *Jun. 30, 2020**

(54) CORE ELECTRIC WIRE FOR MULTI-CORE CABLE AND MULTI-CORE CABLE

(71) Applicant: SUMITOMO ELECTRIC INDUSTRIES, LTD., Osaka-shi, Osaka (JP)

(72) Inventors: Shigeyuki Tanaka, Osaka (JP); Shinya Nishikawa, Osaka (JP); Hiroyuki Okawa, Kanuma (JP); Takaya Kohori, Kanuma (JP); Yuhei Mayama, Kanuma (JP); Takayuki Hirai, Kanuma (JP)

(73) Assignee: SUMITOMO ELECTRIC INDUSTRIES, LTD., Osaka-shi, Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/453,661

(22) Filed: Jun. 26, 2019

(65) Prior Publication Data

US 2019/0318847 A1 Oct. 17, 2019

Related U.S. Application Data

(63) Continuation of application No. 16/155,308, filed on Oct. 9, 2018, now Pat. No. 10,388,433, which is a (Continued)

(51) Int. Cl.
*H01B 11/02* (2006.01)
*H01B 7/29* (2006.01)

(Continued)

(52) U.S. Cl.
CPC ..... *H01B 11/02* (2013.01); *H01B 3/44* (2013.01); *H01B 3/441* (2013.01); *H01B 3/447* (2013.01);

(Continued)

(58) Field of Classification Search
CPC combination set(s) only.
See application file for complete search history.

(56) References Cited

U.S. PATENT DOCUMENTS 1,643,150 A * 9/1927 Conner ..... F16G 11/02 403/284
2,061,862 A * 11/1936 Wells ..... H01B 7/046 174/106 R (Continued)

FOREIGN PATENT DOCUMENTS

CN 101819832 A 9/2010
CN 102575106 A 7/2012

(Continued)

OTHER PUBLICATIONS

Notice of Allowance dated Jan. 4, 2019 of U.S. Appl. No. 15/904,720.

(Continued)

*Primary Examiner* — William H. Mayo, III
*Assistant Examiner* — Krystal Robinson
(74) *Attorney, Agent, or Firm* — Faegre Drinker Biddle & Reath LLP

(57) ABSTRACT

Provided are a core electric wire for multi-core cable that is superior in flex resistance at low temperature, and a multi-core cable employing the same. A core electric wire for multi-core cable according to an aspect of the present invention comprises a conductor obtained by twisting element wires, and an insulating layer that covers an outer periphery of the conductor, in which, in a transverse cross section of the conductor, a percentage of an area occupied by void regions among the element wires is from 5% to 20%. An average area of the conductor in the transverse cross section is preferably from 1.0 $mm^2$ to 3.0 $mm^2$. An average diameter of the element wires in the conductor is preferably from 40 μm to 100 μm, and the number of the element wires is preferably from 196 to 2,450. The conductor is preferably (Continued)

obtained by twisting stranded element wires obtained by twisting subsets of element wires. The insulating layer preferably comprises as a principal component a copolymer of ethylene and an α-olefin having a carbonyl group.

9 Claims, 6 Drawing Sheets

Related U.S. Application Data continuation of application No. 15/517,615, filed as application No. PCT/JP2015/077880 on Sep. 30, 2015, now Pat. No. 10,176,908.

(51) Int. Cl.

| | |
|---|---|
| ***H01B 3/44*** | (2006.01) |
| ***H01B 7/00*** | (2006.01) |
| ***H01B 7/02*** | (2006.01) |
| ***H01B 7/18*** | (2006.01) |
| ***H01B 13/02*** | (2006.01) |
| ***H01B 7/30*** | (2006.01) |
| *H01B 13/22* | (2006.01) |

(52) U.S. Cl.

CPC ..... *H01B 3/448* (2013.01); *H01B 7/0009* (2013.01); *H01B 7/02* (2013.01); *H01B 7/1875* (2013.01); *H01B 7/29* (2013.01); *H01B 7/30* (2013.01); *H01B 13/0221* (2013.01); *H01B 7/0208* (2013.01); *H01B 7/0275* (2013.01); *H01B 13/02* (2013.01); *H01B 13/22* (2013.01)

(56) References Cited

U.S. PATENT DOCUMENTS

| | | | | |
|---|---|---|---|---|
| 4,331,379 | A * | 5/1982 | Oestreich | G02B 6/441 385/109 |
| 7,476,114 | B1 | 1/2009 | Contreras | |
| 9,224,519 | B2 | 12/2015 | McLaughlin et al. | |
| 9,928,937 | B2 | 3/2018 | Tanaka et al. | |
| 10,388,432 | B2 | 8/2019 | Tanaka et al. | |
| 10,388,433 | B2 | 8/2019 | Tanaka et al. | |
| 2005/0011667 | A1* | 1/2005 | Lee | H01B 7/30 174/128.1 |
| 2009/0071688 | A1* | 3/2009 | Debladis | H01B 7/1825 174/110 R |
| 2010/0012350 | A1 | 1/2010 | Hardi et al. | |
| 2010/0212933 | A1 | 8/2010 | Hayashishita et al. | |
| 2012/0205136 | A1 | 8/2012 | Moriuchi et al. | |
| 2014/0326480 | A1* | 11/2014 | Hashimoto | H01B 7/295 174/113 R |
| 2016/0068119 | A1* | 3/2016 | Hayakawa | B60R 16/0207 174/72 A |

FOREIGN PATENT DOCUMENTS

| | | | |
|---|---|---|---|
| CN | 102867598 | A | 1/2013 |
| CN | 103050186 | A | 4/2013 |
| CN | 103559954 | A | 2/2014 |
| CN | 203673848 | U | 6/2014 |
| CN | 103994924 | A | 8/2014 |
| JP | 2010-198973 | A | 9/2010 |
| JP | 2011-99084 | A | 5/2011 |
| JP | 2012-174337 | A | 9/2012 |
| JP | 2014-220043 | A | 11/2014 |
| JP | 2015-156386 | A | 8/2015 |
| WO | WO-2009/137013 | A1 | 11/2009 |
| WO | WO-2017/05627 | A1 | 1/2017 |
| WO | WO-2017/056279 | A1 | 4/2017 |

OTHER PUBLICATIONS

Notice of Allowance dated Jan. 9, 2019 of U.S. Appl. No. 16/155,216.
Notice of Allowance dated Apr. 10, 2019 of U.S. Appl. No. 16/155,216.
Notice of Allowance dated May 20, 2019 of U.S. Appl. No. 15/904,720.
Notice of Allowance dated Nov. 14, 2017 that issued in U.S. Appl. No. 15/517,640.
U.S. Office Action dated Jul. 13, 2018 that issued in U.S. Appl. No. 15/904,720 including a double patenting rejection on pp. 4-6.
Notification of the First Office Action dated Nov. 6, 2019 is Chinese Patent Application No. 201910493154.1 (5 pages) with an English translation (7 pages).
Office Action dated Nov. 22, 2019 in U.S. Appl. No. 16/260,419.
Notification of the First Office Action dated Oct. 8, 2019 in Chinese Patent Application No. 201910492119.8 (7 pages) with an English translation (6 pages).
Office Action dated Mar. 30, 2020 in related Chinese Patent Application No. 201910493152.2 (10 pages) with an English translation (9 pages).
Chinese handbook, "Technology and Application of Cable Technology," edited by Weidong Wang, China Machine Press, Aug. 2014, pp. 116-119.

* cited by examiner

CORE ELECTRIC WIRE FOR MULTI-CORE CABLE AND MULTI-CORE CABLE

CROSS REFERENCE TO RELATED APPLICATIONS

This application is a continuation of U.S. patent application Ser. No. 16/155,308, filed Oct. 9, 2018, which is a continuation of U.S. patent application Ser. No. 15/517,615, filed Apr. 7, 2017, now U.S. Pat. No. 10,176,908, which is a national stage of International Application No. PCT/JP2015/077880, filed Sep. 30, 2015, the entire contents of each of which are incorporated herein by reference.

TECHNICAL FIELD

The present invention relates to a core electric wire for a multi-core cable and to a multi-core cable.

BACKGROUND ART

A sensor used for an ABS (Anti-lock Brake System), etc. in a vehicle, and an actuator used for an electric parking brake, etc. are connected to a control unit via a cable. As the cable, a cable provided with: a core member (core) obtained by twisting insulated electric wires (core electric wires); and a sheath layer that covers the core member is generally used (refer to Japanese Unexamined Patent Application, Publication No. 2015-156386).

The cable connected to the ABS, the electric parking brake, etc. is intricately bent to be laid out within the vehicle and in accordance with drive of an actuator. In addition, the cable may be exposed to a low temperature of 0° C. or below, depending on a use environment.

PRIOR ART DOCUMENTS

Patent Documents

Patent Document 1: Japanese Unexamined Patent Application, Publication No. 2015-156386

SUMMARY OF THE INVENTION

Problems to be Solved by the Invention

In such a conventional cable, polyethylene is generally used for an insulating layer of the insulated electric wire composing the core in light of insulation properties; however, the cable in which polyethylene is used for an insulating layer is prone to breakage upon bending at low temperature. Therefore, improvement of flex resistance at low temperature is required.

The present invention was made in view of the foregoing circumstances, and an object of the present invention is to provide a core electric wire for a multi-core cable that is superior in flex resistance at low temperature, and a multi-core cable employing the same.

Means for Solving the Problems

A core electric wire for a multi-core cable according to an aspect of the present invention made for solving the aforementioned problems is a core electric wire for a multi-core cable comprising a conductor obtained by twisting element wires, and an insulating layer that covers an outer periphery of the conductor, in which, in a transverse cross section of the conductor, a percentage of an area occupied by void regions among the element wires is no less than 5% and no greater than 20%.

Effects of the Invention

The core electric wire for a multi-core cable and a multi-core cable according to aspects of the present invention are superior in flex resistance at low temperature.

DESCRIPTION OF EMBODIMENTS

Description of Embodiments of Present Invention

Figure 1:
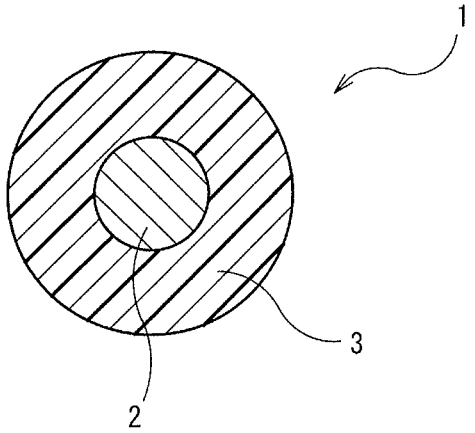
FIG. 1 is a schematic transverse cross sectional view illustrating a core electric wire for a multi-core cable according to a first embodiment of the present invention.

A core electric wire for a multi-core cable according to an embodiment of the present invention for a multi-core cable comprises a conductor obtained by twisting element wires, and an insulating layer that covers an outer periphery of the conductor, in which in a transverse cross section of the conductor, a percentage of an area occupied by void regions among the element wires is no less than 5% and no greater than 20%.

With the percentage of an area of the voids among the element wires being no less than 5%, the core electric wire for a multi-core cable exerts comparatively superior flex resistance at low temperature. A mechanism for this effect is envisaged to involve that: appropriate voids being formed among the element wires absorb deformation in the cross section of the conductor upon bending, to thereby alleviate bend stress applied to the element wires; and this behavior of absorption is less likely to be affected by temperature and is maintained even at a comparatively low temperature. In addition, with the percentage of an area of the voids among the element wires being no greater than 20%, the core electric wire for a multi-core cable is able to maintain an adhesive force between the insulating layer and the conductor, whereby a decrease in workability, etc. is inhibited. It is to be noted that the "transverse cross section" as referred to means a cross section vertical to an axis. In addition, "flex resistance" as referred to means a performance of preventing a break from occurring in a conductor even after repeated bending of an electric wire or a cable.

An average area of the conductor in the transverse cross section is preferably no less than 1.0 $mm^2$ and no greater than 3.0 $mm^2$. In the case of the transverse cross sectional area of the conductor falling within the above range, the core electric wire for a multi-core cable can be suitably used for a multi-core cable for vehicle.

An average diameter of the element wires in the conductor is preferably no less than 40 μm and no greater than 100 μm, and the number of the element wires is preferably no less than 196 and no greater than 2,450. In the case of the average diameter and the number of the element wires falling within the above ranges, development of an effect of improving flex resistance at low temperature can be promoted.

It is preferred that the conductor is obtained by twisting a plurality of stranded element wires, the stranded element wire being obtained by twisting subsets of the element wires. Employing such a conductor (twisted strand wire) obtained by twisting a plurality of stranded element wires, the stranded element wire being obtained by twisting subsets of element wires enables development of an effect of improving flex resistance of the electric wire for a multi-core cable to be promoted.

It is preferred that the insulating layer comprises as a principal component a copolymer of ethylene and an α-olefin having a carbonyl group, and a content of the α-olefin having a carbonyl group in the copolymer is no less than 14% by mass and no greater than 46% by mass. By using, as a principal component of a coating layer, the copolymer of ethylene and an α-olefin having a carbonyl group, with a comonomer ratio falling within the above range, flex resistance of the insulating layer at low temperature can be improved, whereby improvement of flex resistance of the core electric wire at low temperature can be significantly promoted.

It is preferred that the copolymer is an ethylene-vinyl acetate copolymer (EVA) or an ethylene-ethyl acrylate copolymer (EEA). By thus using EVA or EEA as the copolymer, the improvement of flex resistance can be further promoted.

A multi-core cable according to another embodiment of the present invention comprises a core obtained by twisting core electric wires, and a sheath layer disposed around the core, in which at least one of the core electric wires is the core electric wire for a multi-core cable of the aforementioned embodiment.

By virtue of being provided with the core electric wire for a multi-core cable of the aforementioned embodiment as the electric wire constituting the core, the multi-core cable is superior in flex resistance at low temperature.

It is preferred that at least one of the core electric wires is obtained by twisting subsets of the core electric wires. In the case of the core thus comprising the stranded core electric wire, application of the multi-core cable can be expanded while maintaining flex resistance.

Details of Embodiments of Present Invention

The core electric wire for a multi-core cable and the multi-core cable according to embodiments of the present invention are described in detail hereinafter with reference to the drawings.

First Embodiment

The core electric wire for a multi-core cable 1 illustrated in FIG. 1 is an insulated electric wire to be used in a multi-core cable which comprises a core and a sheath layer disposed around the core, the core being formed by twisting core electric wires 1. The core electric wire for a multi-core cable 1 comprises a linear conductor 2 and an insulating layer 3, which is a protective layer, that covers an outer periphery of the conductor 2.

A transverse cross-sectional shape of the core electric wire for a multi-core cable 1 is not particularly limited and may be, for example, a circular shape. In the case in which the transverse cross-sectional shape of the core electric wire for a multi-core cable 1 is a circular shape, an average external diameter thereof varies according to an intended use and may be, for example, no less than 1 mm and no greater than 10 mm.

<Conductor>

The conductor 2 is formed by twisting element wires at a constant pitch. The element wire is not particularly limited and examples thereof include a copper wire, a copper alloy wire, an aluminum wire, an aluminum alloy wire, and the like. The conductor 2 employs a stranded element wire obtained by twisting element wires, and is preferably a twisted strand wire obtained by further twisting stranded element wires. The stranded element wires to be twisted each preferably have the same number of element wires being twisted.

The number of element wires is appropriately determined in accordance with an intended use of the multi-core cable and a diameter of each element wire, and the lower limit is preferably 196 and more preferably 294. Meanwhile, the upper limit of the number of the element wires is preferably 2,450 and more preferably 2,000. Examples of the twisted strand wire include: a twisted strand wire, having 196 element wires in total, obtained by twisting 7 stranded element wires each obtained by twisting 28 element wires; a twisted strand wire, having 294 element wires in total, obtained by twisting 7 stranded element wires each obtained by twisting 42 element wires; a twisted strand wire, having 1,568 element wires in total, obtained by twisting 7 secondary stranded element wires each having 224 element wires, obtained by twisting 7 primary stranded element wires each obtained by twisting 32 element wires; and a twisted strand wire, having 2,450 element wires in total, obtained by twisting 7 secondary stranded element wires each having 350 element wires, obtained by twisting 7 primary stranded element wires each obtained by twisting 50 element wires; and the like.

The lower limit of an average diameter of the element wire is preferably 40 μm, more preferably 50 μm, and further more preferably 60 μm. Meanwhile, the upper limit of the average diameter of the element wire is preferably 100 μm and more preferably 90 μm. In the case of the average diameter of the element wire being less than the lower limit or being greater than the upper limit, the effect of improving flex resistance of the core electric wire for a multi-core cable 1 may not be sufficiently provided.

The lower limit of a percentage of an area occupied by void regions among the element wires in a transverse cross section of the conductor 2 is 5%, more preferably 6%, and further more preferably 8%. Meanwhile, the upper limit of the percentage of an area occupied by the void regions is 20%, more preferably 19%, and further more preferably 18%. In the case of the percentage of an area occupied by the void regions being less than the lower limit, a great bending stress is more likely to be locally applied to the element wire during bending of the multi-core cable, whereby flex resistance may be decreased. To the contrary, in the case of the percentage of an area occupied by the void regions being greater than the upper limit, extrusion moldability of the insulating layer 3 may be inferior, whereby roundness of the core electric wire for a multi-core cable 1 and an adhesive force between the insulating layer 3 and the conductor 2 may be decreased. As a result, the conductor 2 is more likely to be displaced with respect to the insulating layer 3 when the conductor 2 is exposed at a terminal, whereby workability at the terminal may be decreased. In addition, the core electric wire for a multi-core cable 1 is more likely to deform and to allow water to penetrate thereinto.

It is to be noted that the area of the void regions among the element wires is a value obtained by, using a photograph of a transverse cross section of an insulated electric wire comprising a conductor and an insulating layer covering an outer periphery thereof, subtracting a sum of cross sectional areas of the element wires from an area of a region surrounded by the insulating layer (a cross sectional area of the conductor including a gap between the insulating layer and the conductor, and voids among the element wires). A specific procedure for obtaining the area of the void regions is, for example, an image processing comprising binarizing contrast between element wire parts and void parts in the photograph of the transverse cross section, and then obtaining an area of the void parts. The image processing can be performed by, for example: binarizing the image by using a software program such as PaintShop Pro; setting a threshold value through visual observation for correct determination of boundaries of the element wires; and obtaining a percentage of an area of each of the binarized regions by means of a histogram.

The lower limit of an average area of the conductor 2 (including the voids among the element wires) in the transverse cross section is preferably 1.0 $mm^2$, more preferably 1.5 $mm^2$, further more preferably 1.8 $mm^2$, and yet more preferably 2.0 $mm^2$. Meanwhile, the upper limit of the average area of the conductor 2 in the transverse cross section is preferably 3.0 $mm^2$ and more preferably 2.8 $mm^2$. In the case of the average area of the conductor 2 in the transverse cross section falling within the above range, the core electric wire for a multi-core cable 1 can be suitably used for a multi-core cable for vehicle.

Examples of an adjustment procedure for the area of the void regions among the element wires in the transverse cross section of the conductor 2 include: adjustment of an average diameter and the number of the element wire; adjustment of tension during twisting of the element wires; adjustment of the number of pre-twisting, a helical pitch and a helical angle of the element wires; adjustment of an extrusion diameter upon extrusion molding of the insulating layer 3; adjustment of a resin extrusion pressure; and the like.

<Insulating Layer>

The insulating layer 3 is formed from a composition comprising a synthetic resin as a principal component, and is laminated around an outer periphery of the conductor 2 so as to cover the conductor 2. An average thickness of the insulating layer 3 is not particularly limited and may be, for example, no less than 0.1 mm and no greater than 5 mm. The "average thickness" as referred to means an average value of thicknesses measured at arbitrary 10 positions. It is to be noted that the expression "average thickness" used hereinafter for another member, etc. has the same definition.

A principal component of the insulating layer 3 is not particularly limited as long as the component has insulation properties, and is preferably a copolymer of ethylene and an α-olefin having a carbonyl group (hereinafter, may be also referred to as "principal component resin"), in light of improvement of the flex resistance at low temperature. The lower limit of the content of the α-olefin having a carbonyl group in the principal component resin is preferably 14% by mass and more preferably 15% by mass. Meanwhile, the upper limit of the content of the α-olefin having a carbonyl group is preferably 46% by mass and more preferably 30% by mass. In the case of the content of the α-olefin having a carbonyl group being less than the lower limit, the effect of improving the flex resistance at low temperature may be insufficient. To the contrary, in the case of the content of the α-olefin having a carbonyl group being greater than the upper limit, mechanical properties such as strength of the insulating layer 3 may be inferior.

Examples of the α-olefin having a carbonyl group include: alkyl (meth)acrylates such as methyl (meth)acrylate and ethyl (meth)acrylate; aryl (meth)acrylates such as phenyl (meth)acrylate; vinyl esters such as vinyl acetate and vinyl propionate; unsaturated acids such as (meth)acrylic acid, crotonic acid, maleic acid, and itaconic acid; vinyl ketones such as methyl vinyl ketone and phenyl vinyl ketone; (meth)acrylic acid amides; and the like. Of these, alkyl (meth)acrylates and vinyl esters are preferred; and ethyl acrylate and vinyl acetate are more preferred.

Examples of the principal component resin include resins such as EVA, EEA, an ethylene-methyl acrylate copolymer (EMA) and an ethylene-butyl acrylate copolymer (EBA), among which EVA and EEA are preferred.

The lower limit of a mathematical product C*E is preferably 0.01, wherein C is a linear expansion coefficient of the insulating layer 3 at from 25° C. to −35° C., and E is a modulus of elasticity at −35° C. Meanwhile, the upper limit of the mathematical product C*E is preferably 0.9, more preferably 0.7, and further more preferably 0.6. In the case of the mathematical product C*E being less than the lower limit, the mechanical properties such as strength of the insulating layer 3 may be insufficient. To the contrary, in the case of the mathematical product C*E being greater than the upper limit, the insulating layer 3 is less likely to deform at low temperature, whereby the flex resistance of the core electric wire for a multi-core cable 1 at low temperature may be decreased. It is to be noted that C*E can be adjusted by the content of the α-olefin, the proportion of the principal component resin contained, and the like. In addition, the "linear expansion coefficient" as referred to means a linear expansion rate measured in accordance with a method of determination of dynamic mechanical properties defined in JIS-K7244-4 (1999), which is a value calculated from a dimension change of a thin plate with a temperature change using a viscoelasticity measuring apparatus (e.g., "DVA-220" manufactured by IT KEISOKU SEIGYO K.K.), in a pulling mode under conditions of: a temperature range of −100° C. to 200° C.; a rate of temperature rise of 5° C./min; a frequency of 10 Hz; and a skew of 0.05%. The "modulus of elasticity" as referred to means a value measured in accordance with a method of determination of dynamic mechanical properties defined in JIS-K7244-4 (1999), which is a value of storage elastic modulus measured by using a viscoelasticity measuring apparatus (e.g., "DVA-220" manufactured by IT KEISOKU SEIGYO K.K.), in a pulling mode under conditions of: a temperature range of −100° C. to 200° C.; a rate of temperature rise of 5° C./min; a frequency of 10 Hz; and a skew of 0.05%.

The lower limit of the linear expansion coefficient C of the insulating layer 3 at from 25° C. to −35° C. is preferably $1\times10^{-5}$ $K^{-1}$, and more preferably $1\times10^{-4}$ $K^{-1}$. Meanwhile, the upper limit of the linear expansion coefficient C of the insulating layer 3 is preferably $2.5\times10^{-4}$ $K^{-1}$, and more preferably $2\times10^{-4}$ $K^{-1}$. In the case of the linear expansion coefficient C being less than the lower limit, the mechanical properties such as strength of the insulating layer 3 may be insufficient. To the contrary, in the case of the linear expansion coefficient C of the insulating layer 3 being greater than the upper limit, the insulating layer 3 is less likely to deform at low temperature, whereby the flex resistance of the core electric wire for a multi-core cable 1 at low temperature may be decreased.

The lower limit of the modulus of elasticity E of the insulating layer 3 at −35° C. is preferably 1,000 MPa and more preferably 2,000 MPa. Meanwhile, the upper limit of the modulus of elasticity E of the insulating layer 3 is preferably 3,500 MPa and more preferably 3,000 MPa. In the case of the modulus of elasticity E of the insulating layer 3 being less than the lower limit, the mechanical properties such as strength of the insulating layer 3 may be insufficient. To the contrary, in the case of the modulus of elasticity E of the insulating layer 3 being greater than the upper limit, the insulating layer 3 is less likely to deform at low temperature, whereby the flex resistance of the core electric wire for a multi-core cable 1 at low temperature may be decreased.

The insulating layer 3 may contain an additive such as a fire retardant, an auxiliary flame retardant agent, an antioxidant, a lubricant, a colorant, a reflection imparting agent, a masking agent, a processing stabilizer, a plasticizer, and the like. The insulating layer 3 may also contain an additional resin other than the aforementioned principal component resin.

The upper limit of the content of the additional resin is preferably 50% by mass, more preferably 30% by mass, and further more preferably 10% by mass. Alternatively, the insulating layer 3 may contain substantially no additional resin.

Examples of the fire retardant include: halogen-based fire retardants such as a bromine-based fire retardant and a chlorine-based fire retardant; non-halogen-based fire retardants such as metal hydroxide, a nitrogen-based fire retardant and a phosphorus-based fire retardant; and the like. These fire retardants may be used either alone of one type, or in combination of two or more types thereof.

Examples of the bromine-based fire retardant include decabromo diphenylethane and the like. Examples of the chlorine-based fire retardant include chlorinated paraffin, chlorinated polyethylene, chlorinated polyphenol, perchloropentacyclodecane, and the like. Examples of the metal hydroxide include magnesium hydroxide, aluminum hydroxide, and the like. Examples of the nitrogen-based fire retardant include melamine cyanurate, triazine, isocyanurate, urea, guanidine, and the like. Examples of the phosphorus-based fire retardant include a metal phosphinate, phosphaphenanthrene, melamine phosphate, ammonium phosphate, an ester phosphate, polyphosphazene, and the like.

As the fire retardant, the non-halogen-based fire retardant is preferred, and the metal hydroxide, the nitrogen-based fire retardant, and the phosphorus-based fire retardant are more preferred, in light of reduction of environmental load.

The lower limit of the content of the fire retardant in the insulating layer 3 is preferably 10 parts by mass, and more preferably 50 parts by mass, with respect to 100 parts by mass of a resin component. Meanwhile, the upper limit of the content of the fire retardant is preferably 200 parts by mass and more preferably 130 parts by mass. In the case of the content of the fire retardant being less than the lower limit, a fire retarding effect may not be sufficiently imparted. To the contrary, in the case of the content of the fire retardant being greater than the upper limit, extrusion moldability of the insulating layer 3 may be impaired, and mechanical properties such as extension and tensile strength may be impaired.

In the insulating layer 3, the resin component is preferably crosslinked. Examples of a procedure of crosslinking the resin component of the insulating layer 3 include: a procedure of irradiating with an ionizing radiation; a procedure of using a thermal crosslinking agent; a procedure of using a silane graftmer; and the like, and the procedure of irradiating with an ionizing radiation is preferred. In addition, in order to promote crosslinking, it is preferred to add a silane coupling agent to a composition for forming the insulating layer 3.

<Production Method of Core Electric Wire for Multi-Core Cable>

The core electric wire for a multi-core cable 1 can be obtained by a production method mainly comprising a step of twisting element wires (twisting step), and a step of forming the insulating layer 3 that covers an outer periphery of the conductor 2 obtained by twisting the element wires (insulating layer forming step).

Examples of a procedure of covering the outer periphery of the conductor 2 with the insulating layer 3 include a procedure of extruding a composition for forming the insulating layer 3 to the outer periphery of the conductor 2.

It is preferred that the production method of the core electric wire for a multi-core cable 1 further comprises a step of crosslinking the resin component of the insulating layer 3 (crosslinking step). The crosslinking step may take place either prior to covering the conductor 2 with the composition for forming the insulating layer 3, or subsequent to the covering (formation of the insulating layer 3).

The crosslinking can be caused by irradiating the composition with an ionizing radiation. As the ionizing radiation, for example, a γ-ray, an electron beam, an X-ray, a neutron ray, a high-energy ion beam, and the like may be employed. The lower limit of the irradiation dose of the ionizing radiation is preferably 10 kGy, and more preferably 30 kGy. Meanwhile, the upper limit of the irradiation dose of the ionizing radiation is preferably 300 kGy and more preferably 240 kGy. In the case of the irradiation dose being less than the lower limit, a crosslinking reaction may not proceed sufficiently. To the contrary, in the case of the irradiation dose being greater than the upper limit, the resin component may be degraded.

<Advantages>

With the percentage of an area of the voids among the element wires falling within the above range, the core electric wire for a multi-core cable 1 allows voids to be appropriately formed among the element wires, and absorbs deformation of the cross section of the conductor during bending, whereby a bending stress applied to the element wires may be alleviated. In addition, this behavior is less likely to be affected by temperature and is maintained even at a comparatively low temperature. As a result, the core electric wire for a multi-core cable 1 exerts comparatively superior flex resistance at low temperature. In addition, the core electric wire for a multi-core cable 1 is able to maintain an adhesive force between the insulating layer and the conductor, thereby enabling a decrease in workability at a terminal, etc. to be inhibited.

Second Embodiment

Figure 2:
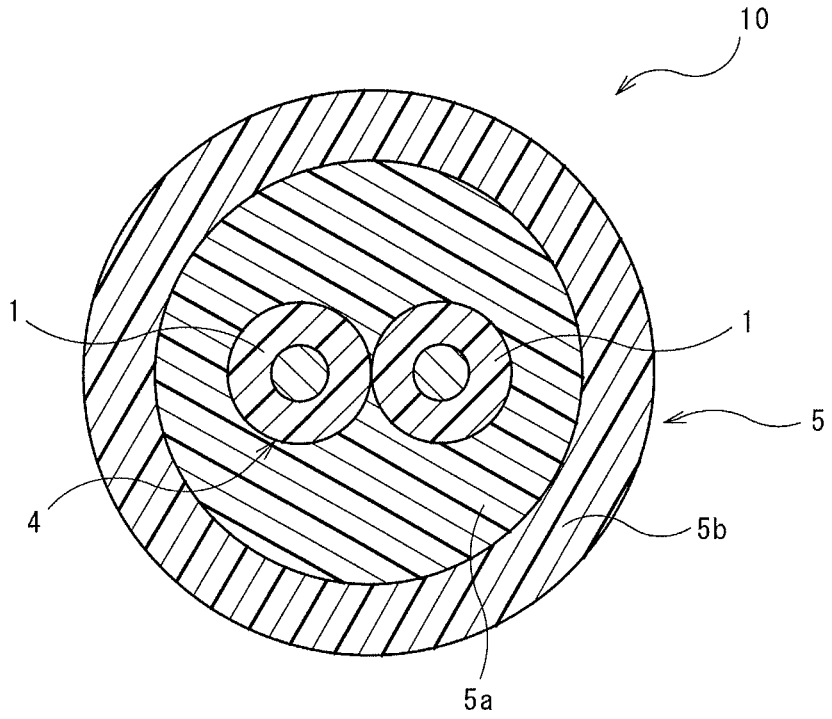
FIG. 2 is a schematic transverse cross sectional view illustrating a multi-core wire according to a second embodiment of the present invention.

A multi-core cable 10 illustrated in FIG. 2 comprises a core 4 obtained by twisting a plurality of the core electric wires for a multi-core cable 1 of FIG. 1, and a sheath layer 5 disposed around the core 4. The sheath layer 5 has an inner sheath layer 5*a* (interlayer) and an outer sheath layer 5*b* (outer coat). The multi-core cable 10 can be suitably used as a cable for transmitting an electric signal to a motor that drives a brake caliper of an electrical parking brake.

An external diameter of the multi-core cable 10 is appropriately determined in accordance with an intended use. The lower limit of the external diameter is preferably 6 mm and more preferably 8 mm. Meanwhile, the upper limit of the external diameter of the multi-core cable 10 is preferably 16 mm, more preferably 14 mm, further more preferably 12 mm, and particularly preferably 10 mm.

<Core>

The core 4 is formed by pair-twisting two core electric wires for a multi-core cable 1 of the same diameter. The core electric wire for a multi-core cable 1 has the conductor 2 and the insulating layer 3 as described in the foregoing.

<Sheath Layer>

The sheath layer 5 has a two-layer structure with the inner sheath layer 5*a* that is laminated around an outer side of the core 4, and the outer sheath layer 5*b* that is laminated around an outer periphery of the inner sheath layer 5*a*.

A principal component of the inner sheath layer 5*a* is not particularly limited as long as it is a flexible synthetic resin, and examples thereof include: polyolefins such as polyethylene and EVA; polyurethane elastomers; polyester elastomers; and the like. These may be used in mixture of two or more types thereof.

The lower limit of a minimum thickness of the inner sheath layer 5*a* (minimum distance between the core 4 and the outer periphery of the inner sheath layer 5*a*) is preferably 0.3 mm and more preferably 0.4 mm. Meanwhile, the upper limit of the minimum thickness of the inner sheath layer 5*a* is preferably 0.9 mm and more preferably 0.8 mm. The lower limit of an external diameter of the inner sheath layer 5*a* is preferably 6.0 mm and more preferably 7.3 mm. Meanwhile, the upper limit of the external diameter of the inner sheath layer 5*a* is preferably 10 mm and more preferably 9.3 mm.

A principal component of the outer sheath layer 5*b* is not particularly limited as long as it is a synthetic resin superior in flame retardance and abrasion resistance, and examples thereof include a polyurethane and the like.

An average thickness of the outer sheath layer 5*b* is preferably no less than 0.3 mm and no greater than 0.7 mm.

In the inner sheath layer 5*a* and the outer sheath layer 5*b*, respective resin components are preferably crosslinked. A crosslinking procedure for the inner sheath layer 5*a* and the outer sheath layer 5*b* may be similar to the crosslinking procedure for the insulating layer 3.

In addition, the inner sheath layer 5*a* and the outer sheath layer 5*b* may contain an additive exemplified for the insulating layer 3.

It is to be noted that a tape member such as a paper tape may be wrapped around the core 4 as an anti-twist member between the sheath layer 5 and the core 4.

<Production Method of Multi-Core Cable>

The multi-core cable 10 can be obtained by a production method comprising a step of twisting a plurality of core electric wires for a multi-core cable 1 (twisting step), and a step of covering with the sheath layer an outer side of the core 4 obtained by twisting the plurality of core electric wires for a multi-core cable 1 (sheath layer application step).

Figure 3:
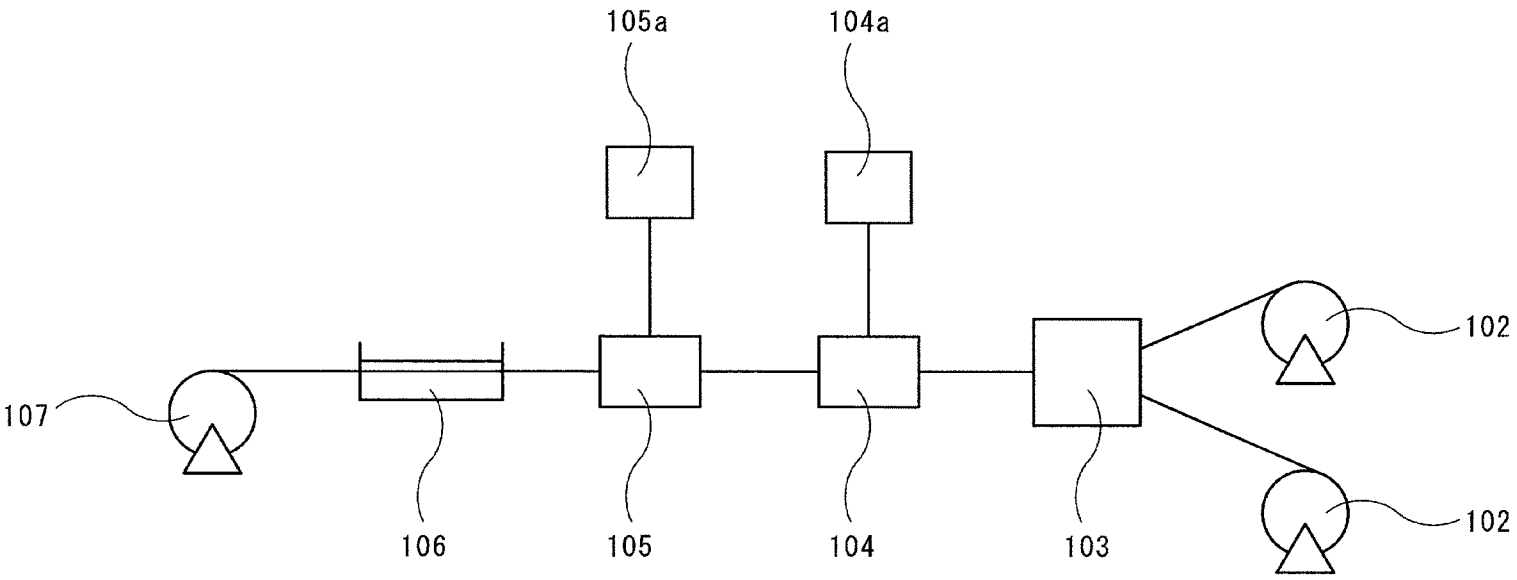
FIG. 3 is a schematic view illustrating a producing apparatus of the multi-core cable according to the present invention.

The production method of the multi-core cable can be performed by using a production apparatus for a multi-core cable illustrated in FIG. 3. The production apparatus for a multi-core cable mainly comprises: a plurality of core electric wire supply reels 102; a twisting unit 103; an inner sheath layer application unit 104; an outer sheath layer application unit 105; a cooling unit 106; and a cable winding reel 107.

(Twisting Step)

In the twisting step, the core electric wires for a multi-core cable 1 wound on the plurality of core electric wire supply reels 102 are respectively supplied to the twisting unit 103, where the core electric wires for a multi-core cable 1 are twisted to form the core 4.

(Sheath Layer Application Step)

In the sheath layer application step, the inner sheath layer application unit 104 extrudes a resin composition for the inner sheath layer, which is contained in a reservoir unit 104*a*, to an outer side of the core 4 formed in the twisting unit 103. The outer side of the core 4 is thus covered with the inner sheath layer 5*a*.

Subsequent to the covering with the inner sheath layer 5*a*, the outer sheath layer application unit 105 extrudes a resin composition for the outer sheath layer, which is contained in a reservoir unit 105*a*, to an outer periphery of the inner sheath layer 5*a*. The outer periphery of the inner sheath layer 5*a* is thus covered with the outer sheath layer 5*b*.

Subsequent to the covering with the outer sheath layer 5*b*, the core 4 is cooled in the cooling unit 106 to harden the sheath layer 5, thereby obtaining the multi-core cable 10. The multi-core cable 10 is wound by the cable winding reel 107.

It is preferred that the production method of the multi-core cable further comprises a step of crosslinking the resin component of the sheath layer 5 (crosslinking step). The crosslinking step may take place either prior to covering the conductor 4 with the composition forming the sheath layer 5, or subsequent to the covering (formation of the sheath layer 5).

The crosslinking can be caused by irradiating the composition with an ionizing radiation, similarly to the case of the insulating layer 3 of the core electric wire for a multi-core cable 1. The lower limit of the irradiation dose of the ionizing radiation is preferably 50 kGy, and more preferably 100 kGy. Meanwhile, the upper limit of the irradiation dose of the ionizing radiation is preferably 300 kGy and more preferably 240 kGy. In the case of the irradiation dose being less than the lower limit, a crosslinking reaction may not proceed sufficiently. To the contrary, in the case of the irradiation dose being greater than the upper limit, the resin component may be degraded.

<Advantages>

By virtue of having the core electric wire for a multi-core cable 1 of the aforementioned embodiment as the electric wire constituting the core, the multi-core cable 10 for a multi-core cable is superior in flex resistance at low temperature.

Third Embodiment

Figure 4:
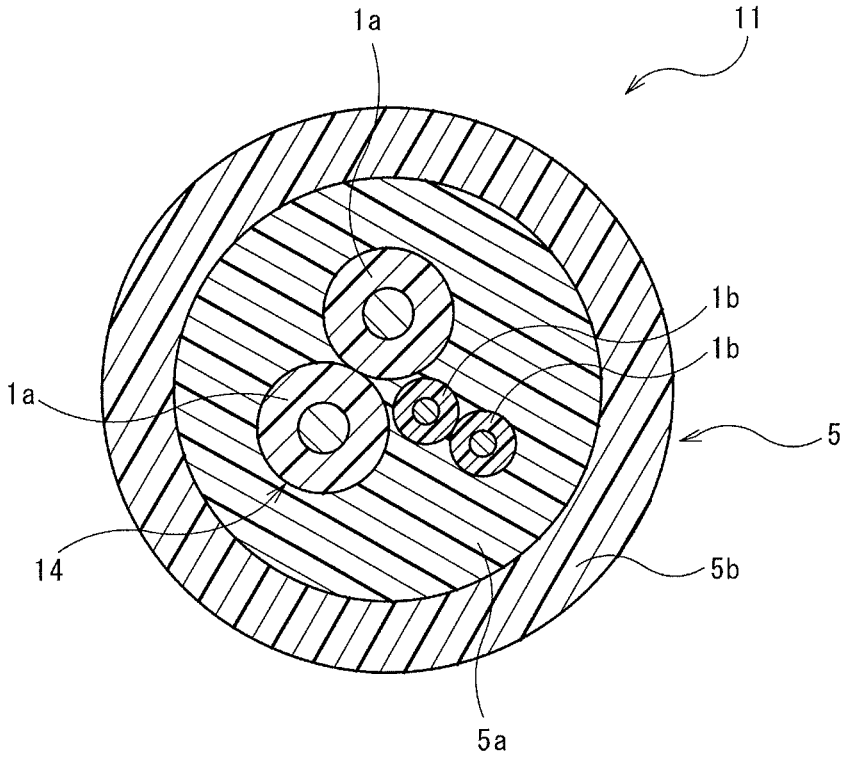
FIG. 4 is a schematic transverse cross sectional view illustrating a multi-core cable according to a third embodiment of the present invention.

A multi-core cable 11 illustrated in FIG. 4 comprises a core 14 obtained by twisting a plurality of the core electric wires 1 of FIG. 1, and a sheath layer 5 disposed around the core 14. Unlike the multi-core cable 10 of FIG. 2, the multi-core cable 11 is provided with the core 14 that is obtained by twisting the plurality of the core electric wires for a multi-core cable of different diameters. In addition to a use as a signal cable for an electric parking brake, the multi-core cable 11 may also be suitably used for transmitting an electric signal for controlling a behavior of an ABS. It is to be noted that the sheath layer 5 is identical to the sheath layer 5 of the multi-core cable 10 of FIG. 2 and is referred to by the same reference numeral, and thus explanation thereof is omitted.

<Core>

The core 14 is formed by twisting: two first core electric wires 1*a* of the same diameter; and two second core electric wires 1*b* of the same diameter, which is smaller than the diameter of the first core electric wires 1*a*. Specifically, the core 14 is formed by twisting the two first core electric wires 1*a* with a stranded core electric wire obtained by pair-twisting the two second core electric wires 1*b*. In the case of using the multi-core cable 11 as a signal cable for a parking brake and for an ABS, the stranded core electric wire obtained by twisting the second core electric wires 2*b* transmits a signal for the ABS.

The first core electric wire 1*a* is identical to the core electric wire for a multi-core cable 1 of FIG. 1. The second core electric wire 1*b* is the same in configuration except for a dimension of a transverse cross section, and may also be the same in material, as the first core electric wire 1*a*.

<Advantages>

The multi-core cable 11 is able to transmit not only an electric signal for an electric parking brake installed in a vehicle, but also an electric signal for an ABS.

Other Embodiments

Embodiments disclosed herein should be construed as exemplary and not limiting in all respects. The scope of the present invention is not limited to the configurations of the aforementioned embodiments but rather defined by the Claims, and intended to encompass any modification within the meaning and scope equivalent to the Claims.

The insulating layer of the core electric wire for a multi-core cable may be in a multilayer structure. In addition, the sheath layer of the multi-core cable may be either a single layer or in a multilayer structure with three or more layers.

The multi-core cable may also include as a core electric wire an electric wire other than the core electric wire for a multi-core cable of the present invention. However, in order to effectively provide the effects of the invention, it is preferred that every core electric wire is the core electric wire for a multi-core cable of the present invention. In addition, the number of the core electric wires in the multi-core cable is not particularly limited as long as the number is no less than 2, and may be 6, etc.

Furthermore, the core electric wire for a multi-core cable may also have a primer layer that is directly laminated onto the conductor. For the primer layer, a crosslinkable resin such as ethylene containing no metal hydroxide may be suitably used in a crosslinked state. Providing such a primer layer enables prevention of deterioration over time of peelability between the insulating layer and the conductor.

Examples

The core electric wire for a multi-core cable and the multi-core cable according to the embodiments of the present invention are described more specifically by means of Examples; however, the present invention is not limited to the Production Examples described below.

Formation of Core Electric Wire

Core electric wires of Nos. 1 to 7 were obtained by preparing compositions for forming the insulating layer according to formulae shown in Table 1, followed by forming an insulating layer having an external diameter of 3 mm by extruding each of the compositions for forming the insulating layer to an outer periphery of a conductor (average diameter: 2.4 mm) that had been obtained by twisting 7 stranded element wires each obtained by twisting 72 annealed copper element wires each having an average diameter of 80 μm. The insulating layer was irradiated with an electron beam of 60 kGy to crosslink the resin component.

It is to be noted that "EEA" in Table 1 is "DPDJ-6182" available from NUC Corporation (ethyl acrylate content: 15% by mass).

In addition, in Table 1, "fire retardant" is aluminum hydroxide ("HIGILITE (registered trademark) H-31" available from Showa Denko K.K.), and "antioxidant" is "IRGANOX (registered trademark) 1010" available from BASF Japan Ltd.

Formation of Multi-Core Cable

A second core electric wire was obtained by twisting two core electric wires each obtained by forming an insulating layer having an external diameter of 1.45 mm by extruding a crosslinked flame retardant polyolefin to an outer periphery of a conductor (average diameter: 0.72 mm) that had been obtained by twisting 60 copper alloy element wires each having an average diameter of 80 μm. Subsequently, two of the aforementioned core electric wires of the same type and the second core electric wire were twisted together to form a core, followed by covering the periphery of the core with a sheath layer by extrusion, to thereby obtain multi-core cables of Nos. 1 to 7. The sheath layer being formed had: an inner sheath layer comprising a crosslinked polyolefin as a principal component with a minimum thickness of 0.45 mm and an average external diameter of 7.4 mm; and an outer sheath layer comprising a flame retardant crosslinked polyurethane as a principal component with an average thickness of 0.5 mm and an average external diameter of 8.4 mm. It is to be noted that crosslinking of the resin component of the sheath layer was caused by irradiation with an electron beam of 180 kGy.

Percentage of Area Occupied by Void Regions

Figure 5:
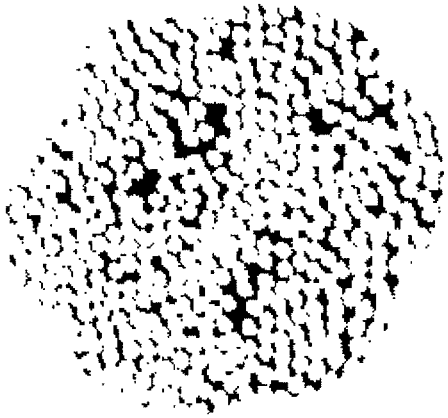
FIG. 5 is a diagram illustrating an example of binarization of an image of a transverse cross section of a conductor.

For each of the conductors of the core electric wires of Nos. 1 to 7, a photograph image of a transverse cross section was binarized as shown in FIG. 5 by using "Photoshop Pro 8", and a percentage of an area occupied by void regions among the element wires in the transverse cross section of the conductor was obtained. The results are shown in Table 1.

Insulation Pulling Force

For each of the core electric wires of Nos. 1 to 7, the insulating layer was removed while leaving a portion of 50 mm in an axial direction, to thereby expose the conductor. Subsequently, the conductor was inserted through a hole, of which an internal diameter was greater than the conductor diameter and smaller than the insulating layer external diameter, provided on a metal plate (thickness: 5 mm), followed by pulling up the conductor at a rate of 200 mm/min while fixing the metal plate. Here, the insulating layer is caught by the metal plate, and only the conductor is pulled out from the insulating layer. A force required for pulling out the conductor of 50 mm in length from the insulating layer of 50 mm in length was measured, and a maximum value was obtained as an insulation pulling force. The results are shown in Table 1.

Flex Test

Figure 6:
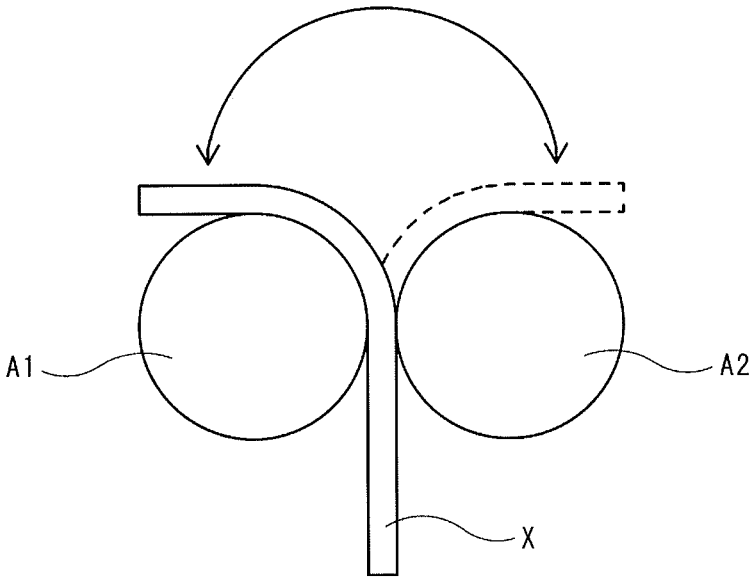
FIG. 6 is a schematic view illustrating a flex test in Examples.

As illustrated in FIG. 6, each of the multi-core cables X of Nos. 1 to 7 was placed perpendicularly between two mandrels A1 and A2 each having a diameter of 60 mm arranged horizontally and parallel to each other, and repeatedly bent from side to side at 90° in a horizontal direction such that an upper end thereof was in contact with an upper side of the mandrel A1 and then with an upper side of another mandrel A2. The test was conducted under conditions of: a downward load of 2 kg applied to a lower end of the multi-core cable X; a temperature of −30° C.; and a bending rate of 60 times/min. During the test, the number of times of bending before a break in the multi-core cable (a state unable to carry a current) occurred was counted. The results are shown in Table 1.

TABLE 1

| | | | No. 1 | No. 2 | No. 3 | No. 4 | No. 5 | No. 6 | No. 7 |
|---|---|---|---|---|---|---|---|---|---|
| Insulating Layer | EEA | Parts by mass | 100 | 100 | 100 | 100 | 100 | 100 | 100 |
| | Fire Retardant | Parts by mass | 70 | 70 | 70 | 70 | 70 | 70 | 70 |
| | Antioxidant | Parts by mass | 2 | 2 | 2 | 2 | 2 | 2 | 2 |
| Conductor | Percentage of Area Occupied by Void Regions | % | 2 | 4 | 5 | 10 | 20 | 22 | 25 |
| Core Electric Wire | Insulation Pulling Force | N/30 mm | 80 | 70 | 60 | 50 | 20 | 10 | 5 |
| Multi-core Cable | Number of Times of Bending | — | 3000 | 7900 | 27000 | 30000 | 37000 | 50000 | 65000 |

As shown in Table 1, the cables Nos. 3 to 5, in which the percentage of an area occupied by the void regions was no less than 5%, were superior in the flex resistance at low temperature with a larger number of times of bending before a break at low temperature, and exhibited the insulation pulling force of no less than 20 N/30 mm, which indicates superior workability at a terminal. On the other hand, the cables Nos. 1 and 2, in which the percentage of an area occupied by the void regions was less than 5%, exhibited insufficient flex resistance at low temperature. The cables Nos. 6 and 7, in which the percentage of an area occupied by the void regions was greater than 20%, exhibited the insulation pulling force of less than 20 N/30 mm, which indicates poor practical performance.

INDUSTRIAL APPLICABILITY

The core electric wire for a multi-core cable according to the embodiment of the present invention and the multi-core cable employing the same are superior in flex resistance at low temperature.

EXPLANATION OF THE REFERENCE SYMBOLS

1, 1*a*, 1*b* Core electric wire for a multi-core cable
2 Conductor
3 Insulating layer
4, 14 Core
5 Sheath layer
5*a* Inner sheath layer
5*b* Outer sheath layer
10, 11 Multi-core cable
102 Core electric wire supply reel
103 Twisting unit
104 Inner sheath layer application unit
104*a*, 105*a* Reservoir unit
105 Outer sheath layer application unit
106 Cooling unit
107 Cable winding reel
A1, A2 Mandrel
X Multi-core cable

The invention claimed is:

1. A multi-core cable comprising a core obtained by twisting core electric wires, wherein at least one of the core electric wires comprises: a conductor obtained by twisting element wires; and an insulating layer that covers an outer periphery of the conductor, a percentage of an area occupied by void regions among the element wires in a transverse cross section of the conductor is no less than 5%, and number of times of bending before a break is no less than 27,000, as counted by a procedure comprising:

placing the multi-core cable perpendicularly between two mandrels each having a diameter of 60 mm arranged horizontally and parallel to each other, with a load of 2 kg applied to a lower end of the multi-core cable; and repeatedly bending the multi-core cable from side to side at 90° in a horizontal direction such that an upper end thereof is in contact with an upper side of one mandrel and then with an upper side of other mandrel, at a temperature of −30° C. and a bending rate of 60 times/min.

2. The multi-core cable according to claim 1, wherein an average area of the conductor in the transverse cross section is no less than 1.0 $mm^2$ and no greater than 3.0 $mm^2$.

3. The multi-core cable according to claim 1, wherein an average diameter of each of the element wires in the conductor is no less than 40 μm and no greater than 100 μm, and number of the element wires is no less than 196 and no greater than 2,450.

4. The multi-core cable according to claim 1, wherein the conductor is obtained by twisting a plurality of stranded element wires, and the stranded element wire is obtained by twisting subsets of the element wires.

5. The multi-core cable according to claim 1, wherein an average thickness of the insulating layer is no less than 0.1 mm and no greater than 5 mm.

6. The multi-core cable according to claim 1, wherein an external diameter of the multi-core cable is no greater than 16 mm.

7. The multi-core cable according to claim 1, wherein at least two of the core electric wires each comprise the conductor and the insulating layer, and in a transverse cross section of the conductor of the at least two of the core electric wires, a percentage of an area occupied by void regions among the element wires is no less than 5%.

8. The multi-core cable according to claim 1, further comprising a sheath layer disposed around the core, wherein a thickness of the sheath layer is no less than 0.3 mm and no greater than 10 mm.

9. The multi-core cable according to claim 1, which is to be connected to at least one of an ABS (Anti-lock Brake System) and an electric parking brake in a vehicle.

* * * * *